United States Patent [19]

Ochs

[11] Patent Number: 4,993,572

[45] Date of Patent: Feb. 19, 1991

[54] PRESSURE VENTING CLOSURE

[75] Inventor: Charles S. Ochs, Lancaster, Ohio

[73] Assignee: Anchor Hocking Corporation, Lancaster, Ohio

[21] Appl. No.: 401,999

[22] Filed: Sep. 1, 1989

[51] Int. Cl.[5] ..... B65D 51/16

[52] U.S. Cl. ..... 215/260; 215/276; 220/366

[58] Field of Search ..... 215/260, 271, 270, 276; 220/366

[56] References Cited

U.S. PATENT DOCUMENTS

| | | | |
|---|---|---|---|
| 2,032,931 | 3/1936 | Gibbs | 215/260 |
| 2,270,729 | 1/1942 | Geddes . | |
| 2,449,014 | 9/1948 | Shaffer . | |
| 3,114,467 | 12/1963 | Montgomery | 215/260 |
| 4,093,094 | 6/1978 | Smalley et al. | 215/276 |
| 4,880,127 | 11/1989 | Doi | 215/252 |

*Primary Examiner*—Stephen Marcus
*Assistant Examiner*—Nova Stucker
*Attorney, Agent, or Firm*—Wood, Herron & Evans

[57] ABSTRACT

A composite closure for a container vents internal gas pressure in excess of a pre-established maximum. An insert disk fits inside an overhanging top lip of the closure. The undersurface of the top lip is recessed to present a chamber into which excess gas pressure beneath the cover can deflect the disk and thereby provide a vent under the disk. A stop on a small area of the undersurface of the top lip positively abuts the disk to prevent blocking the chamber if the closure is overtightened.

9 Claims, 1 Drawing Sheet

PRESSURE VENTING CLOSURE

FIELD OF THE INVENTION

This invention relates to a container closure which automatically vents excess gas pressure within the container.

BACKGROUND

Some food products tend to ferment rather rapidly after the containers in which they are packaged have been opened and sterility has been lost by exposure to air. This is especially apt to happen with fruit juices, for example. The fermentation evolves gases which, if the container closure is resealed, cause internal gas pressure to increase, especially if there is relatively little "head space" above the level of the food product in the container. Apart from fermentation, excessively high internal gas pressure in a container can arise in other ways, for example if the container is overheated while sealed. In extreme cases such internal pressure can reach a level so high as to rupture and shatter a container. In the packaging industry internal gas pressures in excess of 40 pounds are considered undesirably high.

For this reason there has been a need for a closure which will effectively seal and reseal a container against ordinary internal gas pressures but which will automatically vent or release a gas pressure which exceeds some predetermined limiting value.

THE PRIOR ART

Geddes U.S. Pat. No. 2,270,729 shows a two-piece closure having an inturned flange at the top with radial corrugations for strengthening the flange and a plain (uncorrugated) band around the inner edge of the flange. The patent does not discuss venting pressure from beneath the disk; its objective is to maintain a hermetic seal by preventing the flange from bending upwardly.

Sheffer U.S. Pat. No. 2,449,014 shows a closure which has a flexible hinge portion between an overhanging top part and a skirt or side part. The hinge is said to provide a lower venting point during pressure processing while still insuring good sealing characteristics.

Smalley U.S. Pat. No. 4,093,094 discloses a home canning system having a composite closure which allows excess pressure to escape. The closure includes a plastic ring which has an annular top panel and a skirt depending from the outer periphery of the top panel. The ring has an upwardly and outwardly inclined ramp portion on its lower surface and a thin section at the junction of the top panel and the skirt. These elements combine to form a spring which maintains a downward force that biases a metal lid into sealing engagement with the rim of a home canning jar.

SUMMARY OF THE INVENTION

The closure of this invention is a composite (i.e., two-piece) closure comprising, as one part, an annular plastic shell having a top opening and a threaded skirt for securing it onto a container. As used herein the term "threaded" comprehends both continuous threads and interrupted threads or lugs. The shell has an overhanging top lip which surrounds a top opening. A separate insert disk, typically of metal or plastic, is contained in the top opening of the shell and fits beneath the top lip.

The disk includes a gasket on its undersurface for engaging and sealing the top of a container.

The top lip has at least one recessed or relief area on its undersurface, which is spaced from and does not contact or bear down on the disk. The top lip also has at least one downwardly projecting boss, stop, or bearing area on its undersurface which, when the closure is applied to a container, does engage and bear downwardly on the disk and stops the closure as it is being tightened. Thus when a container is sealed the bearing area of the lip, but not the recessed area, positively engages and bears down on the top disk, the bearing area acting as a stop to prevent the disk from blocking or filling the recessed area if the closure is torqued too tightly. The recessed area is sized to permit excess gas pressure in the container, that is, pressure in excess of a predetermined limit, to deflect or elastically distend the disk upwardly into the recessed area and away from the top of the container, and thereby permit excess gas pressure to be released below the disk.

The invention can best be further described by reference to the accompanying drawings, in which, FIG. 1 is a perspective view of a container with a composite closure;

DETAILED DESCRIPTION

Figure 1:
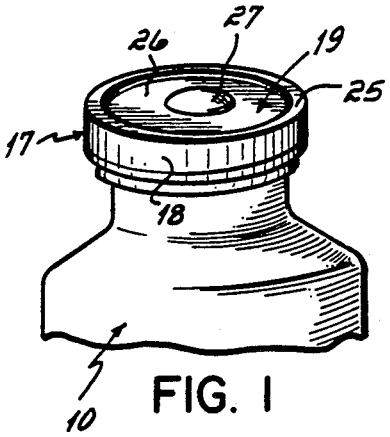

The closure of this invention is used with a container 10 having a finish 11 with external threaded means 12 which may be either continuous threads or lugs. The container has a top opening 13 which is surrounded by a sealing rim 14.

Figure 2:
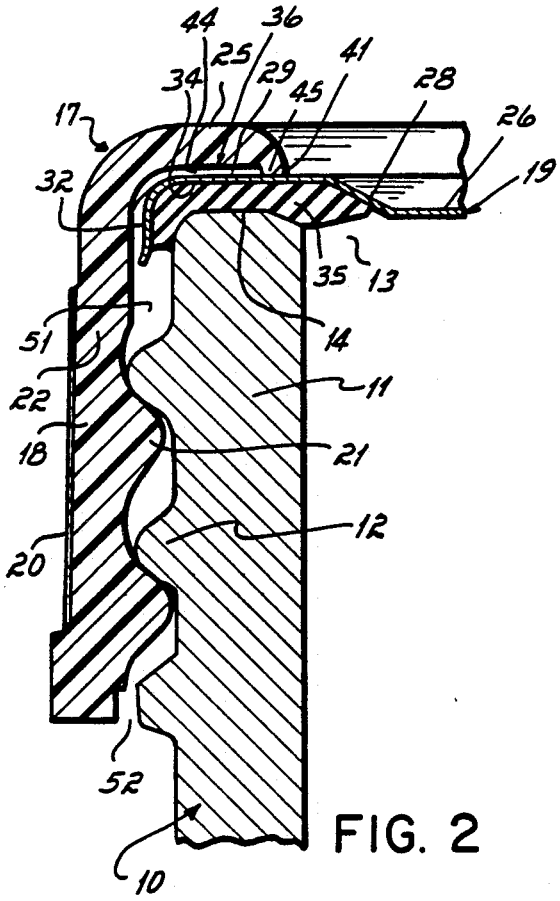
FIG. 2 is an enlarged, partial axial section of a container having a closure in accordance with a preferred embodiment of the invention, and shows the relative positions of the disk and top lip at normal internal gas pressures.

A venting closure 17, in accordance with a preferred embodiment of the invention, is a composite having an annular shell portion 18 and a cover or insert disk 19. The shell 18 is molded of plastic and the disk 19 is metal. As best shown in FIG. 2, shell 18 includes a skirt 22 having external gripping means in the form of ribs 20, internal threads 21 which are engageable with the threads 12 of the container, and a top lip 25 which overhangs the sealing rim 14 of container 10. Shell 18 may optionally be provided with tamper indicating means of a type known per se in the art and which are not shown in the drawings.

Insert disk 19 preferably has a lowered or drop center portion 26 which may include a vacuum button 27. Outwardly of center portion 26 insert disk 19 includes an upwardly and outwardly sloping ramp portion 28 which leads to a raised peripheral portion 29 and a downturned outer rim 32. Taken together, ramp portion 28, peripheral portion 29 and rim 32 of disk 19 define a downwardly opening channel 34 in which a sealing gasket 35 is contained.

Figure 4:
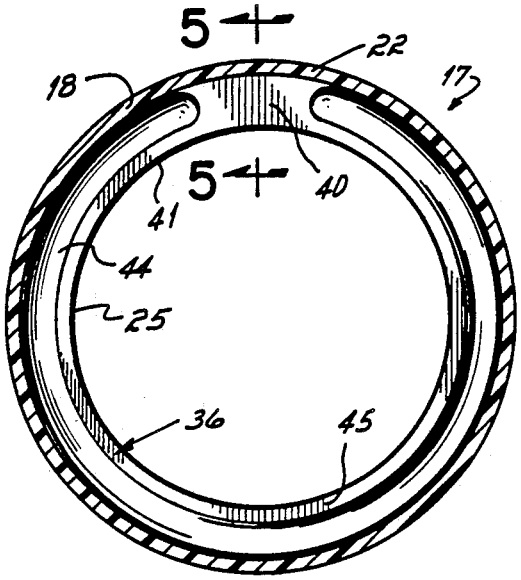
FIG. 4 is a plan view, partially in section, of the underside of the top lip of the closure.

As best shown in FIG. 4, the undersurface 36 of top lip 25 includes at least one bearing area, boss or stop 40 which positively abuts the raised peripheral rim 29 of disk 19 when the closure is applied. The bearing area preferably extends from the inside wall of the skirt 22 of shell 18 to the inner edge 41 of top lip 25. The embodiment shown has a single bearing area 40; two, three or more can be provided depending on cap diameter and desired pressure limit.

One or more recessed areas 44 are also formed in the undersurface of lip 25. In the embodiment shown, the recessed area comprises a channel which extends nearly completely around the circumference of the top lip, being interrupted only by bearing area 40.

It is further preferred, but not absolutely required, to provide a lip 45 inwardly of recess area 44, contiguous to the inner edge 41 of the top lip. This lip may be flexible; its purpose is not necessarily to act as a stop or boss but rather to prevent dirt or other particulate matter on the disk from entering recess 44. It will be appreciated that while boss 40 engages the top of the disk, it does not necessarily exert significant hold-down pressure on it.

Figure 3:
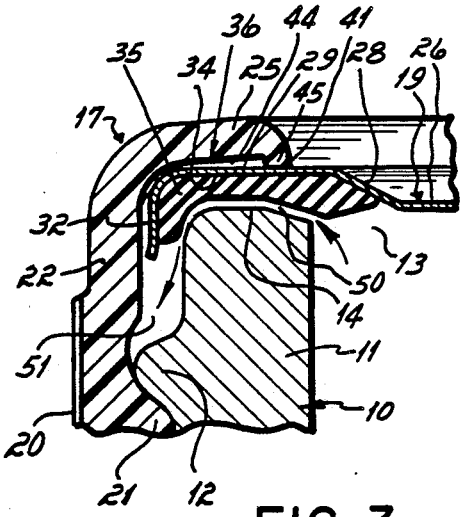
FIG. 3 is a section similar to FIG. 2 but shows the disk deflected into the recess space by excess pressure, to permit excess gas pressure to be vented beneath the disk.

Recess 44 is sized so that pressure in container 10 beneath disk 19, in excess of a predetermined amount, will lift or resiliently deflect the adjacent part of disk 19 toward (i.e., partially into) the recess area, as shown in FIG. 3. This deflection temporarily forms a vent 50 below gasket 35 through which excess gas pressure is released past the gasket 35 into the interthread space 51, and from that through an open space or outlet 52 at the bottom of skirt 22 (see arrows in FIG. 3). It will be apparent that the area of bearing area 40 and its relative relationship to the recessed area controls the desired maximum internal gas pressure. Generally speaking, larger closure sizes and/or greater maximum pressures require a relatively larger bearing area or areas. For many caps the bearing area 40 is a small fraction of the total area of the underside of the top lip, for example about 5–10%.

In some closures the top lip 25 is inherently somewhat flexible because it is cantilevered from the skirt. Were it not for the provision of the bearing area 40, excess pressure in the container would tend to flex or "hinge" the top lid relative to the closure, and the disk edge could improperly close the recess on the the underside of the top lip without forming a venting passage below the gasket. I have found that the bearing area 40 maintains a small but critical spacing between the recess and the disk, so that recess 44 cannot be closed when the closure is sealed. Bearing area 40 applies positive pressure on the disk during closure and prevents blocking the recess area by overtightening.

Figure 5:
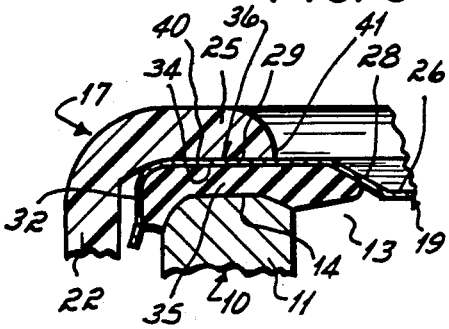
FIG. 5 is a vertical section taken on line 5—5 of FIG. 4, and shows the bearing area.

If, for whatever reason, internal gas pressure in the container increases once the closure has been sealed (or resealed), the pressure acts upwardly on the disk and, if in excess of a predetermined desired limiting value, for example 40 psi, it deflects the disk upwardly toward and partly into the recess area 44, even though the disk is elsewhere confined and held down by the bearing area 40. This action, as shown in FIG. 5, locally forms one or more vents 50 which permit pressure to escape. As that occurs, the lifting force decreases and the resiliency of the disk causes it to close and reseal.

Comparative tests have shown that a closure having a bearing area 40 in accordance with the invention can be made which will vent pressure at 20–40 psi, whereas a cover otherwise identical but without such a stop can be overtightened so as not to release pressure as high as 80 to 100 psi.

Pressure venting closures in accordance with this invention can also be designed to provide a capability for water washing of the interthread region. Such closures are specifically described and claimed in my copending, commonly owned, application Ser. No. 402,211, titled "Container Closure With Internal Channels for Water Washing", filed essentially simultaneously herewith, to which reference may be made. Further, the present closure may have a tamper indicating band as specifically described and claimed in the copending application of Thomas H. Hayes, Ser. No. 401,966, titled "Tamper Indicating Closure Having Retaining Hoop With Relief Windows", filed essentially simultaneously herewith, to which reference may also be made.

Having described the invention, what is claimed is:

1. A composite closure for a container, said closure comprising an annular shell having a top opening and a skirt with threaded means for securing the closure onto a container, and an overhanging top lip which surrounds said top opening, an insert disk contained in said shell beneath said top lip, said disk including a gasket for engaging and sealing the rim of a container, said top lip having on an undersurface thereof at least one recessed area which does not bear on said disk, said top lip also having at least one bearing area for bearing downwardly on said disk, said bearing area having a circumferential dimension which is a small fraction of the circumference of said lip, said bearing area bearing on said disk directly above the rim of said container, said recessed area being sized to permit gas pressure in a container, in excess of a predetermined limit, to deflect said disk upwardly toward said recessed area and away from the rim of said container sufficiently to release excess gas pressure past said rim.

2. The closure of claim 1 wherein said top lip further includes a depending annular rim around said top lip, said rim engaging said disk.

3. The closure of claim 2 wherein said rim of said lip defines an inner edge of said recessed area.

4. The closure of claim 1 wherein said top lip is sufficiently flexible that excess gas pressure on said disk hinges said top lip upwardly relative to said skirt, as said disk is deflected toward said recessed area.

5. The closure of claim 1 wherein said bearing area is sized to bear on said disk over only a small fraction of the area of the undersurface of said top lip.

6. The closure of claim 1 further including an interthread space around said threaded means and between said skirt and said container, excess gas pressure being released past said gasket into said interthread space when said pressure deflects said disk into said recessed area.

7. A composite closure for a container, said closure comprising an annular shell having a top opening and a skirt with threaded means for securing the closure onto a container, and an overhanging top lip which surrounds said top opening, an insert disk contained in said shell beneath said top lip, said disk including a gasket for engaging and sealing the rim of a container, said top lip having on an undersurface thereof at least one recessed area which does not bear on said disk, said top lip also having at least one bearing area for bearing downwardly on said disk, said bearing area including a boss which extends across the width of said lip, said recessed area being sized to permit gas pressure in a container, in excess of a predetermined limit, to deflect said disk upwardly toward said recessed area and away from the rim of said container sufficiently to release excess gas pressure past said rim.

8. A composite closure for a container, said closure comprising an annular shell having a top opening and a skirt with threaded means for securing the closure onto a container, and an overhanging top lip which surrounds said top opening, an insert disk contained in said shell beneath said top lip, said disk including a gasket for engaging and sealing the rim of a container, said top lip having on an undersurface thereof at least one recessed area which does not bear on said disk, said top lip also having at least one bearing area for bearing downwardly on said disk, said recessed area being sized to permit gas pressure in a container, in excess of a predetermined limit, to deflect said disk upwardly toward said recessed area and away from the rim of said container sufficiently to release excess gas pressure past said rim, said top lip including a depending annular rim around it, said rim engaging said disk, said rim of said lip defining an inner edge of said recessed area, said bearing area bearing on said disk radially outwardly of said rim of said top lip.

9. A composite closure for a container, said closure comprising an annular shell having a top opening and s skirt with threaded means for securing the closure onto a container, and an overhanging top lip which surrounds said top opening, an insert disk contained in said shell beneath said top lip, said disk including a gasket for engaging and sealing the rim of a container, said top lip having on an undersurface thereof at least one recessed area which does not bear on said disk, said recessed area being a channel which extends annularly around the undersurface of said top lip, said top lip also having at least one bearing area for bearing downwardly on said disk, said bearing area interrupting said channel, said recessed area being sized to permit gas pressure in a container, in excess of a predetermined limit, to deflect said disk upwardly toward said recessed area and away from the rim of said container sufficiently to release excess gas pressure past said rim.

* * * * *